US007896508B2

(12) United States Patent
Dyson

(10) Patent No.: US 7,896,508 B2
(45) Date of Patent: Mar. 1, 2011

(54) GUN MIRROR

(76) Inventor: William E. Dyson, Washington, DC (US)

( * ) Notice: Subject to any disclaimer, the term of this patent is extended or adjusted under 35 U.S.C. 154(b) by 0 days.

(21) Appl. No.: 10/164,407

(22) Filed: Jun. 10, 2002

(65) Prior Publication Data

US 2003/0227697 A1 Dec. 11, 2003

(51) Int. Cl.
*G02B 7/182* (2006.01)
*F41G 1/00* (2006.01)

(52) U.S. Cl. ..... 359/871; 359/881; 359/543; 359/544; 42/118

(58) Field of Classification Search ..... 359/871, 359/872, 875, 879, 881, 882, 543, 544, 545, 359/880; 42/118, 119; 248/484; 351/50
See application file for complete search history.

(56) References Cited

U.S. PATENT DOCUMENTS 1,227,544 A * 5/1917 Lobdell ..... 356/255
1,260,285 A 3/1918 Cordell
1,264,133 A * 4/1918 Morris ..... 42/118
2,331,616 A * 10/1943 Minghetti ..... 356/255
3,088,451 A 5/1963 Crosby et al.
3,405,469 A * 10/1968 Francois ..... 42/118
3,863,354 A 2/1975 Karppinen
4,105,183 A * 8/1978 Clark ..... 248/484
4,359,266 A 11/1982 Rohlf et al.
4,487,479 A 12/1984 Tolomeo, Sr.
4,758,078 A 7/1988 Bracamonte
5,530,588 A 6/1996 Vivier
5,563,741 A 10/1996 Leonberger
6,178,648 B1 1/2001 Ledys et al.
6,217,180 B1 * 4/2001 Eisenbraum ..... 359/871
6,220,717 B1 4/2001 Pastore

* cited by examiner

*Primary Examiner*—Audrey Y Chang
(74) *Attorney, Agent, or Firm*—Welsh Flaxman & Gitler LLC

(57) ABSTRACT

A mirror attached to a weapon such as a rifle, pistol or shotgun. The gun mirror is a slightly convex mirror seated in a flexible seat which is anchored to a weapon by flexible legs which may be magnetic or have a threaded fastener or have hook/loop fasteners.

4 Claims, 6 Drawing Sheets

GUN MIRROR

BACKGROUND OF THE INVENTION

1. Field of the Invention

The present invention relates to a mirror attached to a weapon to enable a soldier or police officer to determine if a threat exists on the other side of an obstruction.

2. Description of the Related Art

Many casualties have resulted in urban conflict where a soldier or police officer has extended around a corner and met with unexpected fire. Had they had an opportunity to observe around the obstacle without exposure of themselves, they might have been able to determine the threat and found another route or used grenades or even fired their weapon blindly, causing the opponents to flinch or seek cover. The present invention provides a gun mirror not appreciated in the related art.

U.S. Pat. No. 1,260,285 to Cordell for "Periscope Attachment for Rifles" discloses a cumbersome assembly to enable a user to aim a rifle at a target while safely hidden from return fire.

U.S. Pat. No. 1,264,133 to Morris for "Rifle Periscope" discloses a mirror for attachment to a rifle to allow a soldier to sight his weapon at a target while the user is protected from direct fire.

U.S. Pat. No. 3,088,451 to Crosby et al. for "Trick Shot Gun" discloses a mirror incorporated with the rear sight in order to fire the toy gun at a target behind the user, again aiming the toy by use of the mirror.

U.S. Pat. No. 3,863,354 to Karppinen for "Mirror Sight for Small Firearms" discloses a dual mirror sighting attachment which is able to provide a user the ability to sight the weapon at a target while he is behind and below the weapon.

U.S. Pat. No. 4,359,266 to Rohlf et al. for "Rear View Mirror Assembly for Collapsible Stroller" discloses a mechanism to attach a mirror assembly to a tubular structure.

U.S. Pat. No. 4,487,479 to Tolomeo, Sr. for "Hunter's Rear Viewing Mirror Device" discloses a mirror assembly for allowing a hunter to view his rearward aspects without movement and a strap assembly for attachment to a cylindrical structure.

U.S. Pat. No. 4,758,078 to Bracamonte for "Periscoping Rear and Side Vision Mirror Assembly for Motor Vehicles" discloses a mirror attached to a retractable mast for rearward viewing of traffic and an attachment for a mirror to a rod/tube assembly.

U.S. Pat. No. 5,530,588 to Vivier for "Rearview Device" discloses a convex dome mirror with strap assembly for attachment.

U.S. Pat. No. 5,563,741 to Leonberger for "Exterior Rearview Mirror for Motor Vehicles" discloses a mirror assembly for a vehicle with ball/socket mounting of the mirror.

U.S. Pat. No. 6,178,648 B1 to Ledys et al. for "Fastening Device for a Muzzle Mirror" discloses a mirror attached near the muzzle of an artillery piece to determine whether the tube is properly laid. The attachment is effected by use of a band in a groove near the muzzle where the mirror is used to reflect a laser beam from which is determined any bending or other deviation of the tube.

U.S. Pat. No. 6,220,717 B1 to Pastore for "Mirror for Use With Elevated Hunter Stand" discloses a mirror on an assembly which features a flexible rod and a clamp to affix near a hunter to permit the hunter to observe to his rear without turning his head.

None of the above inventions and patents, taken either singularly or in combination, is seen to describe the instant invention as claimed. Thus a gun mirror solving the aforementioned problems is desired.

SUMMARY OF THE INVENTION

The invention is a mirror attached to a weapon such as a rifle, pistol or shotgun to enable a soldier or police officer to determine safely if a threat is apparent on the other side of an obstacle. The gun mirror is a slightly convex mirror seated in a flexible seat. The seat is anchored to a weapon by flexible legs which may be magnetic or have a threaded fastener or have hook/loop fasteners. Instead of being met with aimed fire from unexpected opponents, a user may safely evaluate any threat on an opposite side of an obstacle and make alternative plans before exposure of self or others.

Accordingly, it is a principal object of the invention to enable a user to safely determine if a threat exists on the other side of an obstacle.

It is another object of the invention to affix a general purpose mirror assembly to a weapon to enable a user to have discrete observation around an obstacle.

It is a further object of the invention to make urban combat safer for American troops.

Still another object of the invention is to make police searches or chases safer for the policemen in urban areas.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a mirror, somewhat convex, that is attached to a weapon to be placed around an obstacle and used to determine if there is a threat on the other side of that obstacle.

Figure 1:
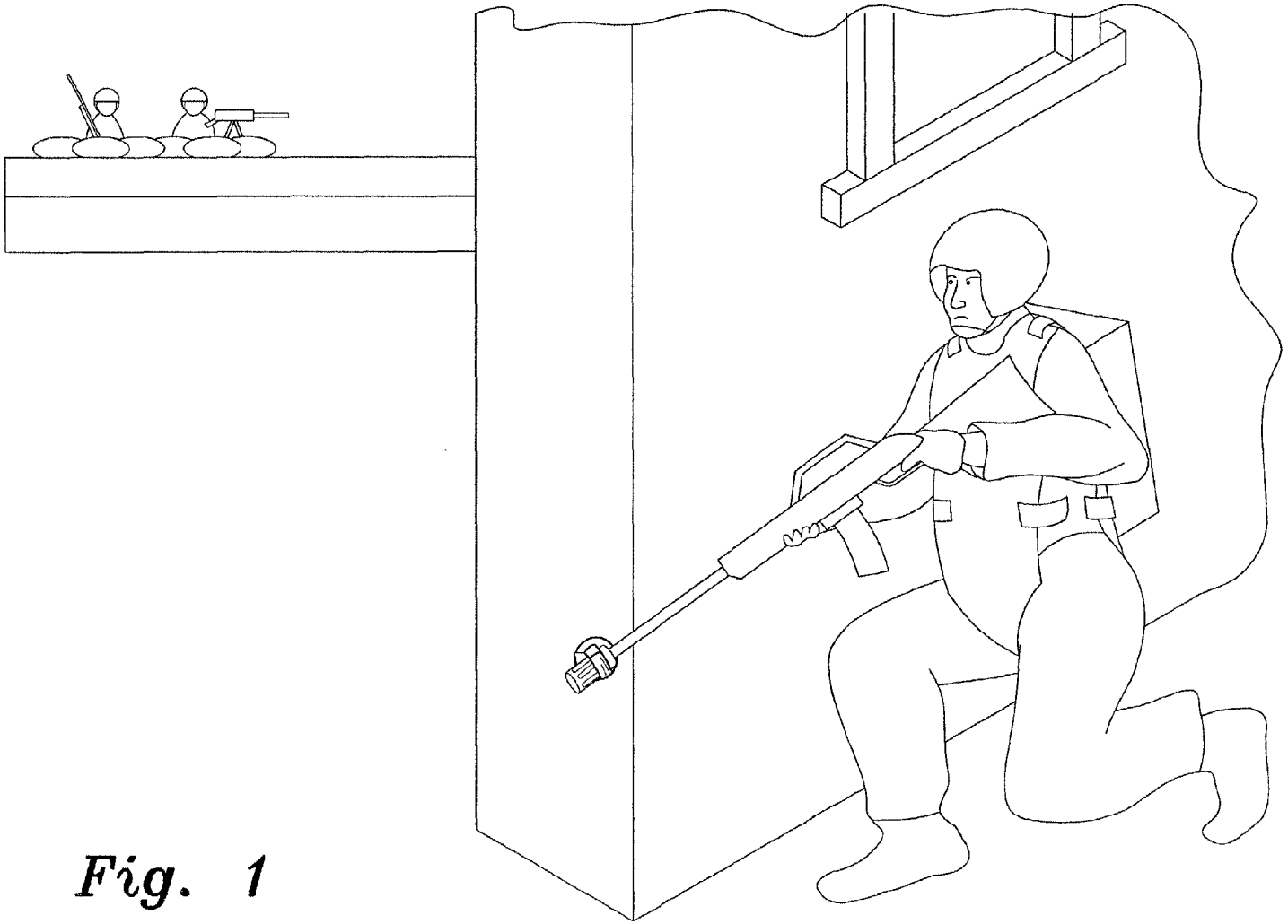
FIG. 1 is an environmental, perspective view of a gun mirror according to the present invention used by a soldier.
Figure 2:
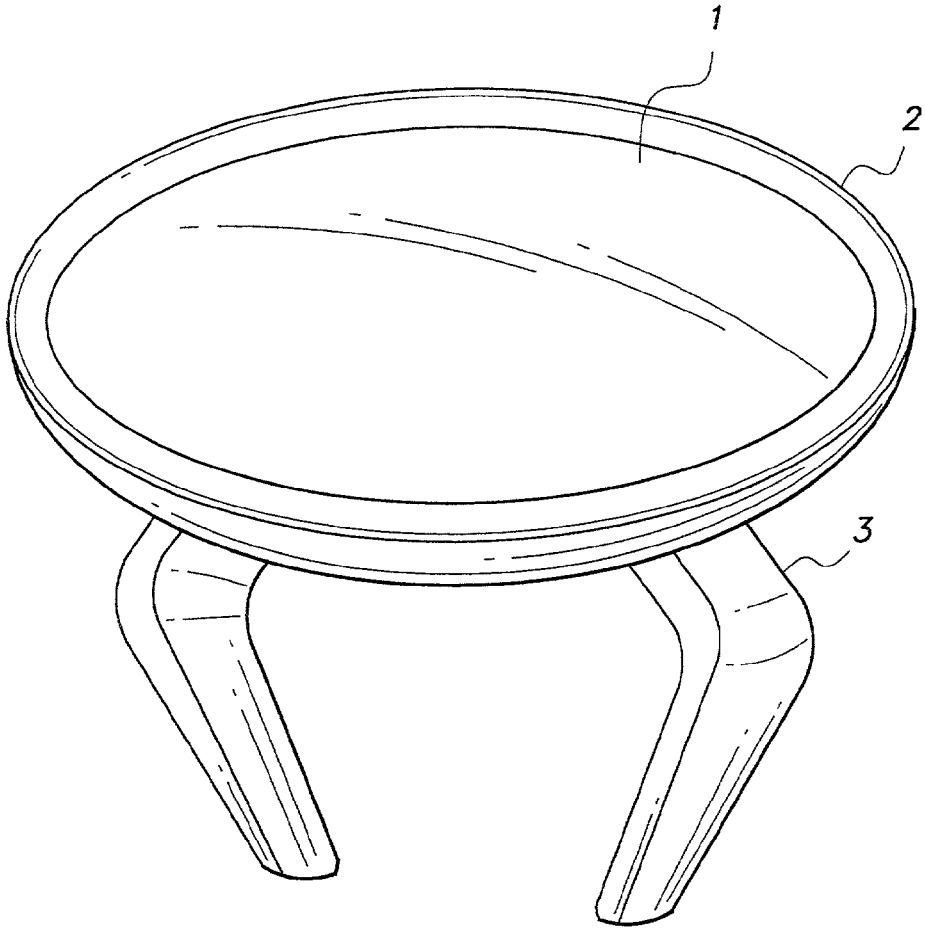
FIG. 2 is an enlarged-scale, perspective view of the gun mirror according to the instant invention.

FIG. 1 shows a mirror 1 that is a bit convex. The convexity of the mirror is to allow a user a wider view around the obstacle with little waving around. It should be understood that the mirror is not to be greatly convex, as that would distort the reflection too much. Though the mirror will reflect and cause some flash, which in a combat situation is totally undesirable, such little flash would be much better than exposure of a person's head to aimed and unexpected fire. Experience has proven that inadvertent exposure can be fatal.

The mirror 1 may be made of any material such as glass, plastic or metal, which can be made to reflect.

The mirror 1 is seated in a rubber or plastic seat 2 which engages and cushions the mirror. Replacement of the mirror is also made much easier if the seat 2 is somewhat flexible. For this reason, it is desirable that the seat 2 not be made from a rigid material such as PVC, acrylics or other hard plastics.

Legs 3 are part of a flexible metal clip for easy attachment to a rifle, pistol or shotgun. In a combat situation where flash could identify a person carrying a weapon from a great distance, the gun mirror may easily be removed and pocketed and reattached at a later time such as when in a built up area. The legs 3 are not only flexible metal but can be magnetic to enhance attachment.

It is also contemplated that the legs may be made from a semi-rigid plastic. If this is done, then the plastic may have magnetic elements embedded therein (not shown).

Figure 3:
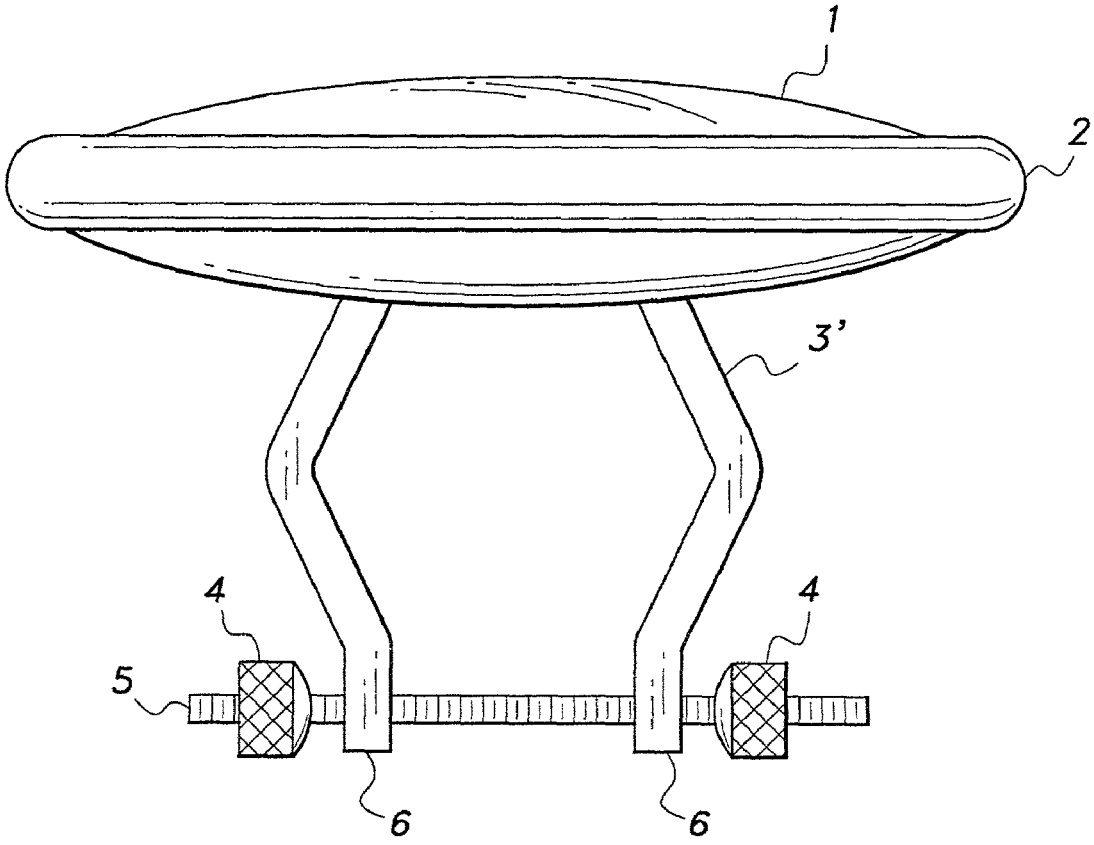
FIG. 3 is a side elevational view of a first embodiment of a gun mirror, with knurled, threaded fasteners to clamp onto a weapon.

The embodiment of FIG. 3 is the same somewhat convex mirror 1 and rubber or plastic seat 2 and at least semi-rigid legs 3' except that the legs 3' end in a mechanical closure with knurled knobs 4 threaded onto bolt 5 which engage leg ends 6. This gun mirror may be tightly attached to a rifle, pistol or shotgun. Care should be taken that when attached to an automatic or semi-automatic weapon that the tight attachment of the gun mirror to the weapon does not interfere with the action of the weapon.

Figure 4:
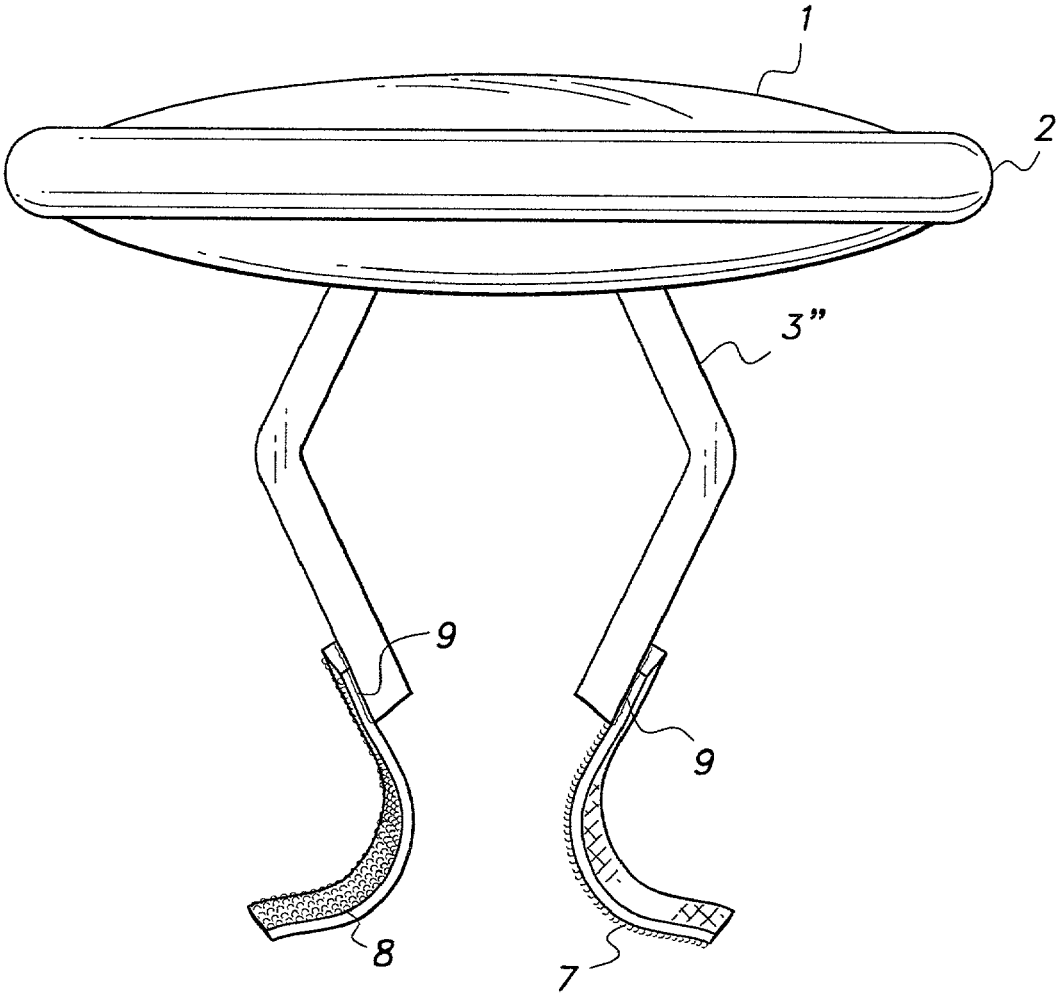
FIG. 4 is a side elevational view of a second embodiment of a gun mirror, with hook and loop fabric fasteners to be attached to a weapon.

The embodiment of FIG. 4 is the same somewhat convex mirror 1 seated in the rubber or plastic seat 2 and the at least semi-rigid legs 3". Legs 3" end in flexible hook and loop material, 7 and 8, fasteners and may be wrapped as tightly as needed about a rifle, pistol or shotgun. The hook/loop fasteners 7 and 8 may be integrally manufactured in molding of the at least semi-rigid legs 3", or threaded into end loops (not shown), or adhered by adhesive 9 to the legs or attached by any means appropriate and effective.

Figure 5:
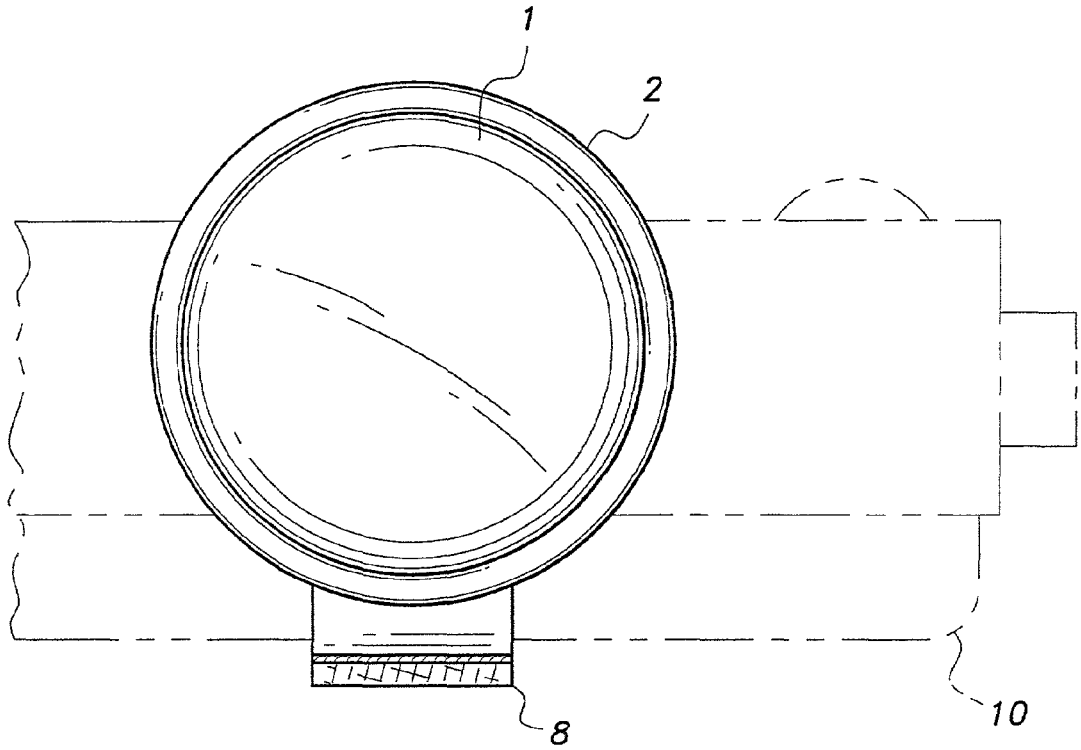
FIG. 5 is a side elevational view of a gun mirror attached to a pistol by hook and loop fasteners.

FIG. 5 shows a gun mirror with hook/loop fasteners attached to a pistol, in phantom, where it may be seen that the legs and fasteners are placed so that aiming the weapon and the action are not restricted or impaired.

Figure 6:
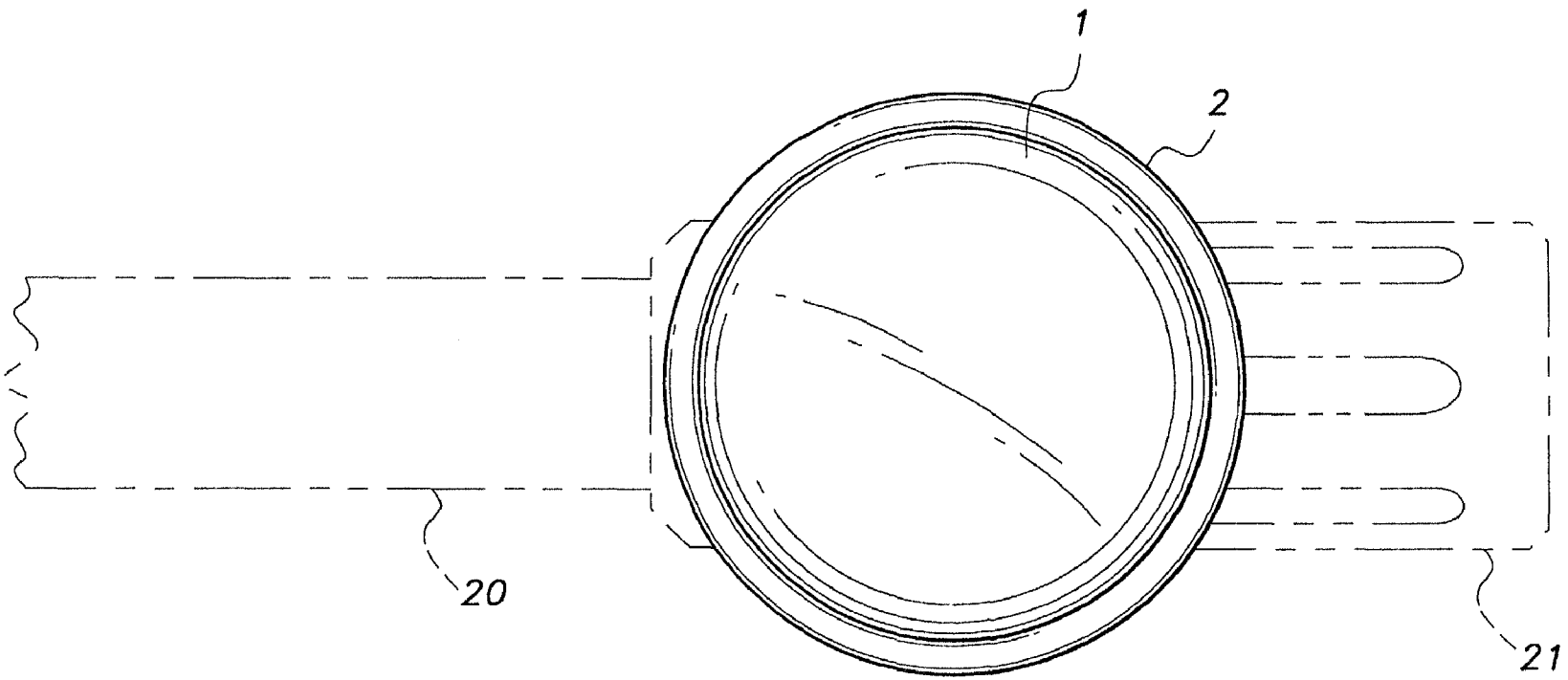
FIG. 6 is a side elevational view of a gun mirror attached to a rifle flash suppressor.

FIG. 6 shows a gun mirror attached to a flash suppressor of a military small arm rifle of the M-16 type. Placement for use may be in any orientation so that aiming the weapon is not impaired, to include along the top of the barrel (not shown).

It is to be understood that the present invention is not limited to the embodiments described above, but encompasses any and all embodiments within the scope of the following claims.

I claim:

1. In combination, a reflective surface and a gun or weapon having a gun sight, comprising a reflective surface having a convex top reflective surface and a back surface, a pair of laterally spaced resilient legs depending from said back surface and extending away from said reflective surface, said laterally spaced legs being biased laterally inwardly toward each other, to thereby form a spring clip, said legs and associated reflective surface being snapped onto the discharge end portion of the gun or weapon barrel at a position offset and remote from the gun sight so as not to impair the aiming of the weapon, whereby the reflective surface is positioned to aid one in seeing around corners prior to firing the gun.

2. The combination of a reflective surface and a gun or weapon, according to claim 1, wherein said legs have bottom end portions, a threaded rod extending through said leg bottom end portions, and a fastener threaded onto opposed end portions of said rod, whereby the reflective surface is fastened to the discharge end portion of the gun or weapon barrel.

3. The combination of a reflective surface and a gun or weapon, according to claim 1, wherein said legs have bottom end portions and hook and loop fasteners adhesively secured to the bottom end portions of said legs for securing the reflective surface to the discharge end portion of the gun or weapon barrel.

4. In combination, a reflective surface and a gun or weapon, according to claim 1, wherein the laterally spaced legs are magnetic.

* * * * *